US005507456A

United States Patent [19]

Brown et al.

[11] Patent Number: 5,507,456

[45] Date of Patent: Apr. 16, 1996

[54] REDUCED HARMONIC SWITCHING MODE APPARATUS AND METHOD FOR RAILROAD VEHICLE SIGNALING

[75] Inventors: James P. Brown, Allison Park; Robert P. Bozio, Pittsburgh, both of Pa.

[73] Assignee: Union Switch & Signal Inc., Pittsburgh, Pa.

[21] Appl. No.: 449,776

[22] Filed: May 24, 1995

Related U.S. Application Data

[63] Continuation of Ser. No. 312,536, Sep. 26, 1994.

[51] Int. Cl.[6] ..... B61L 27/00

[52] U.S. Cl. ..... 246/167 R; 246/1 C; 246/34 B

[58] Field of Search ..... 246/1 C, 62, 64, 246/167 R, 182 R, 191, 34 B, 175, 3, 4, 5, 72, 182 A, 187 A; 375/17; 370/47, 49.5; 340/825.57, 825.63

[56] References Cited

U.S. PATENT DOCUMENTS

| | | |
|---|---|---|
| 2,021,654 | 11/1935 | Kemmerer et al. . |
| 3,398,239 | 8/1968 | Rabow . |
| 3,869,670 | 3/1975 | Grutzmann et al. . |
| 3,980,826 | 9/1976 | Widmer . |
| 4,041,283 | 8/1977 | Mosier . |
| 4,280,221 | 7/1981 | Chun et al. . |
| 4,313,203 | 1/1982 | van Gerwen et al. . |
| 4,314,234 | 2/1982 | Darrow et al. . |
| 4,494,717 | 1/1985 | Corrie et al. . |
| 4,558,316 | 12/1985 | Yong . |
| 4,560,953 | 12/1985 | Bozio . |
| 4,619,425 | 10/1986 | Nagel . |
| 4,732,355 | 3/1988 | Parker . |
| 4,860,309 | 8/1989 | Costello . |
| 5,025,328 | 6/1991 | Silva . |
| 5,271,584 | 12/1993 | Hochman et al. . |
| 5,329,551 | 7/1994 | Wei . |
| 5,330,134 | 7/1994 | Ehrlich . |

*Primary Examiner*—Mark T. Le
*Attorney, Agent, or Firm*—Buchanan Ingersoll

[57] ABSTRACT

A signaling apparatus that includes a transmitter having a step-square wave generator for generating a signaling waveform, which waveform is composed of a plurality of square wave signals, and which has an information signal encoded thereupon. The apparatus may also include a signaling waveform receiver, disposed on the railcar, and an information signal decoder, connected to the receiver, for extracting the information signal from the receiver. The stepped-square wave generator produces square waves such that a portion of the duty cycle of one of a plurality of square wave signals overlaps at least a portion of the duty cycle of at least one other of the plurality of square wave signals. A method for signaling in which a multi-stepped square waveform is generated, includes a waveform having a series of superimposed square waves, each of which having preselected amplitudes and duty cycles. An information signal can be encoded upon the multi-stepped carrier waveform such that a coded-carrier signal is created.

8 Claims, 10 Drawing Sheets

SWITCH DRIVER
218a
307
309
211a
329
331
311
219
230
280a
333
308
218c
335
313
280b
337
218d
218b
315
339
317
211b
341

Fig.6a. CURRENT LIMITED
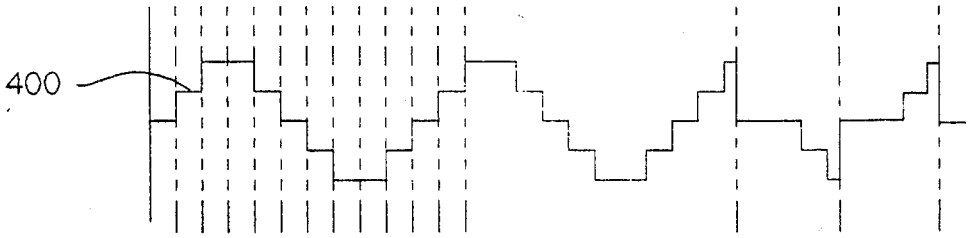
Fig.6b.
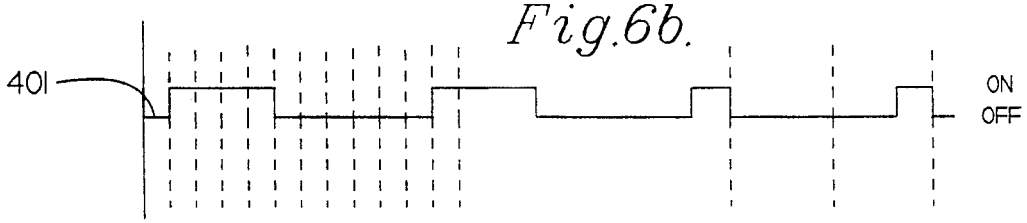
Fig.6c.
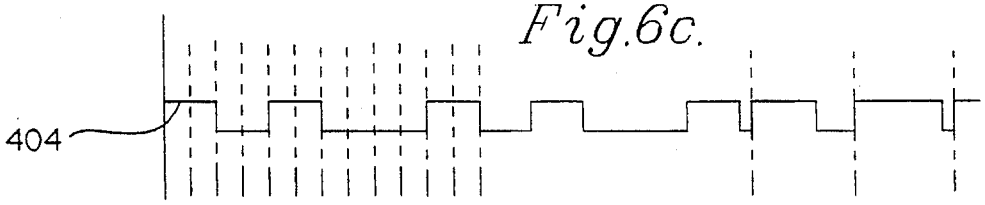
Fig.6d.
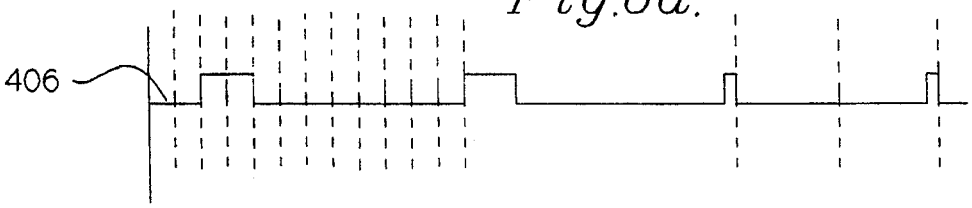
Fig.6e
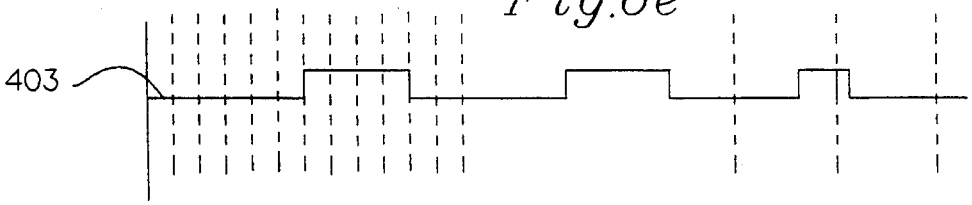
Fig.6f
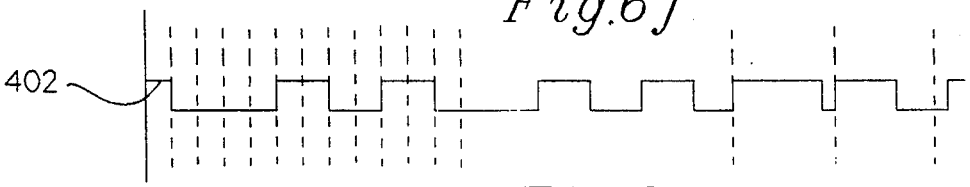
Fig.6g.
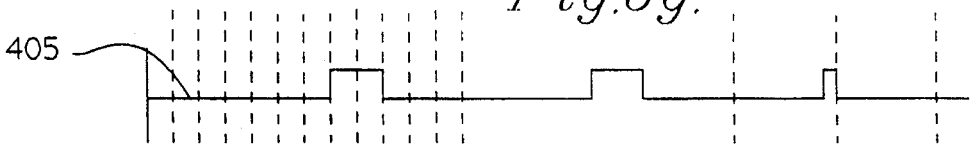

REDUCED HARMONIC SWITCHING MODE APPARATUS AND METHOD FOR RAILROAD VEHICLE SIGNALING

RELATED APPLICATION

This is a continuation of co-pending application Ser. No. 08/312,536, filed Sep. 26, 1994, now pending.

BACKGROUND OF THE INVENTION

1. Field of the Invention

The invention relates to a railroad vehicle signaling apparatus and method for railroad vehicle signaling, particularly, a railroad vehicle information signaling apparatus and method employing a switched-mode transmitter and, more particularly, a railroad vehicle information signaling apparatus employing a stepped-square wave transmitter and method for transmitting carrier-coded railcar information to a railroad vehicle.

2. Description of the Art

Railroad vehicles can receive information such as, for example, speed limit information, by inductively sensing electrical signals in the rails. These signals may consist of a preselected carrier frequency which is modulated on and off at a preselected coding rate. The preselected carrier frequency typically is either 60 or 100 Hertz; and the coding rate typically is 75, 120, or 180 cycles per minute (CPM).

The carrier signal can be generated by switching a DC power source such as a 12 VDC battery, on and off, resulting in a square wave carrier which can be rich in odd harmonics with the third harmonic having one-third as much energy as the fundamental, the fifth harmonic having one-fifth as much energy as the fundamental, etc. Modulating the carrier at the predetermined code rate appends sidebands to each of the harmonics, further adding to the noise spectrum. This noise may preclude the use of some of the other electronic equipment which can be applied across the rails, such as highway crossing motion monitors and predictors, and audio frequency overlay track circuits.

One solution to this problem can be to use a linear amplifier. This allows a clean sine wave to be applied to the rails, thereby eliminating substantially all of the harmonics. However, this approach increases signal generating circuit complexity and, more importantly, power efficiency. What is needed, therefore, is a method and an apparatus for generating the coded-carrier signals which convey information such as, for example, speed limit information, to the cabs of railroad vehicles and which efficiently produce sufficient signal power with reduced low harmonic-frequency spectral "pollution" inherent in standard designs.

SUMMARY OF THE INVENTION

The invention provides for a signaling apparatus that includes a transmitter having a stepped-square wave generator for generating a signaling waveform, which waveform is composed of a plurality of square wave signals and which has an information signal encoded thereupon. The transmitter impresses the signaling waveform through a train rail. The apparatus also may include a signaling waveform receiver disposed on the railcar and an information signal decoder, connected to the receiver, for extracting the information signal from the signaling waveform. It is preferred that the transmitter is a switching-mode transmitter. The stepped-square wave generator produces square waves such that at least a portion of the first preselected duty cycle of at least one of the plurality of square wave signals overlaps at least a portion of a second preselected duty cycle of at least one other of the plurality of square waves so that the signaling waveform is generally a stepped-square waveform. The transmitter may also include a tuned output filter interposed between the transformer output and the train rail.

The transmitter can further comprise a current limiter for limiting the heating of respective ones of the plurality of semiconductor switches.

The stepped-square wave generator can include (1) an encoder for producing an encoded information signal; (2) a clock for producing sequential clocking pulses; (3) a synchronizer connected with the clock and the encoder, which synchronizer is responsive to the encoded information signal and the sequential clocking pulses, thereby producing a plurality of input drive signals; (4) a switch driver responsive to the plurality of input drive signals thereby producing a plurality of gate drive signals; and (5) a signaling transmitter responsive to the plurality of gate drive signals. The signaling transmitter can produce a signaling waveform which has a plurality of square wave signals. A preselected duty cycle of at least one of the plurality of square wave signals overlaps a preselected duty cycle of at least one other of the plurality of square wave signals such that a stepped-square waveform is formed thereby. The signaling waveform is then impressed by the signaling transmitter upon a railroad track by switching the stepped-square wave generator on and off according to a predetermined coding sequence at a preselected coding frequency.

The invention includes a method for signaling in which a multi-stepped square waveform is generated, with the waveform having a series of superimposed square waves. At least two of the square waves have preselected amplitudes. In addition, the duty cycle on one square wave can be overlapped with the duty cycle of another square wave, so that the result is a multi-stepped carrier waveform. The carrier waveform can be characterized as having a single high-amplitude square wave interposed between two lower-amplitude square waves. An information signal can be encoded upon the multi-stepped carrier waveform such that a coded-carrier signal is created. This coded-carrier signal can be injected into a railway track for providing information to a railway vehicle.

The invention also includes a method for signaling which includes the steps of (1) generating a plurality of square-wave signals having a plurality of predetermined duty cycles; (2) overlapping at least a portion of a first preselected duty cycle of at least one of the plurality of square wave signals with at least a portion of a second preselected duty cycle of at least one other of said plurality of square wave signals so that a stepped-square waveform of a predetermined frequency results therefrom; (3) encoding an information signal at a preselected frequency upon at least a portion of the stepped-square waveform; and (4) transmitting the stepped-square waveform having the information signal encoded thereupon into a transmission medium with at least a portion of the transmission medium being a portion of railroad track. It is preferred that the predetermined frequency of the stepped-square waveform is about 60 Hz or 100 Hz, and that the preselected frequency of the encoding is about 75 cycles per minute (CPM), 120 CPM, or 180 CPM.

BRIEF DESCRIPTION OF THE DRAWINGS

FIGS. 6*a–g* illustrate exemplary gate drive signals and resultant voltage output of the stepped-square wave generator of FIGS. 5*a–*5*d* and current limiter in FIG. 5*e*.

DETAILED DESCRIPTION OF THE EMBODIMENTS

In general, the signaling apparatus herein employs a transmitter which may include a stepped-square wave generator for generating a signaling waveform in which a desired information signal is encoded thereupon. The transmitter transmits this signaling waveform through a train rail to a receiver in the train vehicle. The train vehicle receiver may generally consist of a signaling waveform receiver for receiving this signaling waveform which may be present on the track rail and an information signal decoder for extracting the information signal from the signaling waveform. Although the transmitter may use linear amplifiers to amplify the signaling waveform for transmission, it is preferred that a switching-mode transmitter be used to generate the waveform. In addition, a current limiter can be incorporated into the transmitter to limit Joule heating of the semiconductor switches, for example when a train is stopped on top of a track connection. It is preferred to employ a tuned filter on the output in order to filter the step waveform prior to transmission and also to block other signals that may be present on the track.

The signaling waveform may generally be a stepped-square waveform in which the preselected duty cycle of one square wave signal overlaps a preselected duty cycle of another square wave signal such that the resultant signaling waveform amplitude can adopt discrete amplitude values thereby resembling a series of steps.

It is preferred that the stepped-square waveform be produced by a stepped-square wave generator which can include a multi-tap transformer having multiple transformer inputs and at least one transformer output. The waveforms produced by the stepped-square wave generator are produced by a plurality of semiconductor switches connected with the transformer inputs which switches are selectably made to conduct so that the resultant waveform output obtains the desired stepped-square waveform. To ensure the proper sequencing of the semiconductor switches, a switching controller can be connected with the semiconductor switches. The controller can selectively operate the semiconductor switches, thereby controlling the amplitude and duty cycle of the waveform which is produced by a particular transformer tap.

The desired information signal can be encoded upon the signaling waveform using an encoder which is electrically connected with the switching controller. In order to provide a clocking signal at a desired predetermined frequency, a clock also can be incorporated into the switching controller. The clock may be connected with a switch driver to selectively operate respective semiconductor switches, thereby providing a signaling waveform of the desired configuration.

Other details, objects, and advantages of the invention will become apparent as the following description of present embodiments thereof proceeds, as shown in the accompanying drawings.

Figure 1:
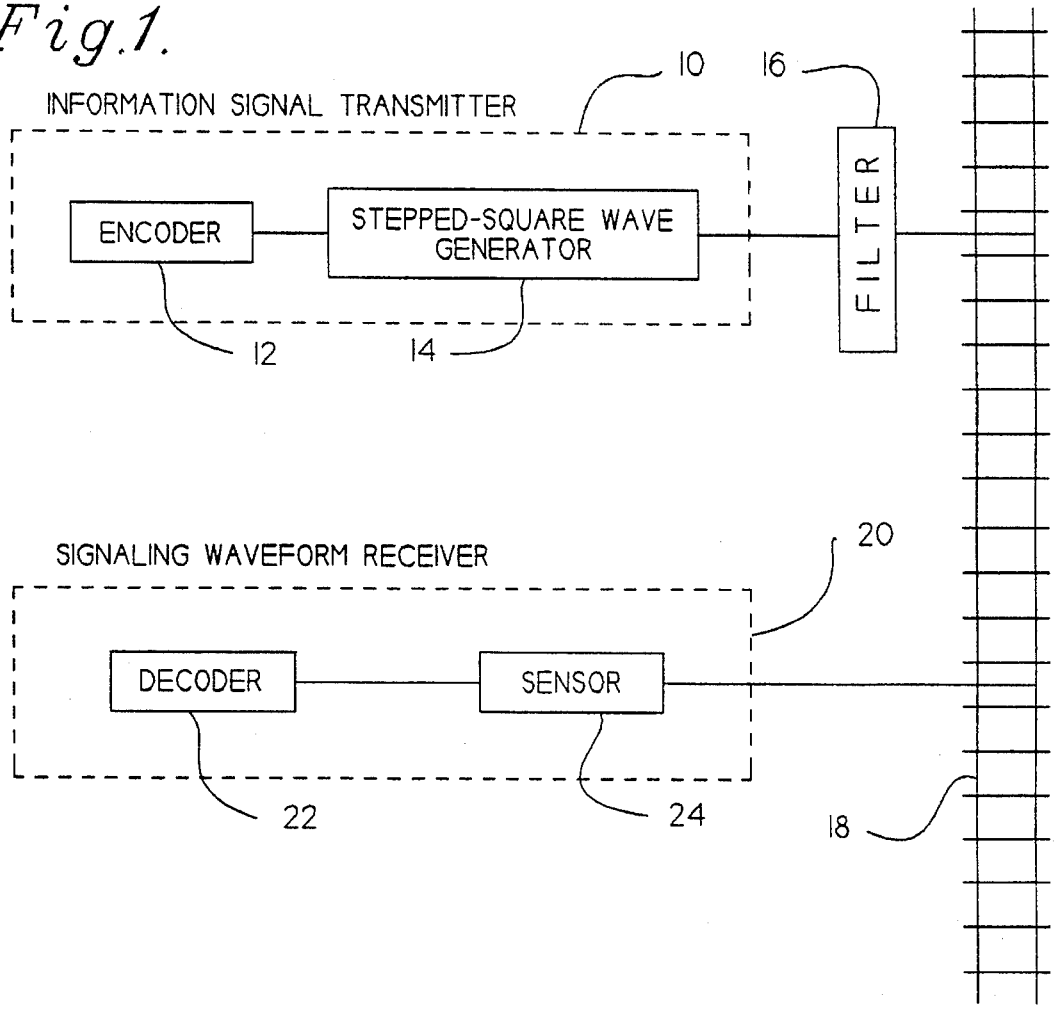
FIG. 1 illustrates the transmitter, receiver, and method for railroad vehicle signaling.

In FIG. 1, information signal transmitter 10 generates a signaling waveform, which waveform can be composed of a plurality of square wave signals onto which an information signal is encoded. It is preferred that information signal transmitter 10 be a switching-mode transmitter. Transmitter 10 employs track rails 18 as the signal transmission medium where signaling waveform receiver 20, preferably located in a cab of a railroad vehicle, intercepts the signaling waveform and extracts an information signal therefrom. In a present embodiment of the present invention, it is preferred that transmitter 10 include a stepped-square wave generator 14 which provides a signaling waveform with information encoded thereupon, and which transmits the signaling waveform through train rails 18. The signaling waveform may be a multi-stepped carrier waveform which, after being encoded, becomes a coded-carrier signal for providing information to a railway vehicle.

It is also preferred to provide an encoder 12, for generating the information signal. Stepped-square wave generator 14 can include encoder 12 therewithin. Output filter 16, preferably a tuned output filter, can be provided for filtering harmonics from the stepped-square waveform and for isolating transmitter 10 from other signals which may be present on track rails 18.

Signaling waveform receiver 20 can receive the signaling waveform from track rails 18 using a sensor 24, for example, a set of pick-up coils. Receiver 20 provides the signaling waveform to information signal decoder 22, whereby the railcar personnel can be apprised of the desired information, and on-board control can utilize the vehicle signal information.

Figure 2A:
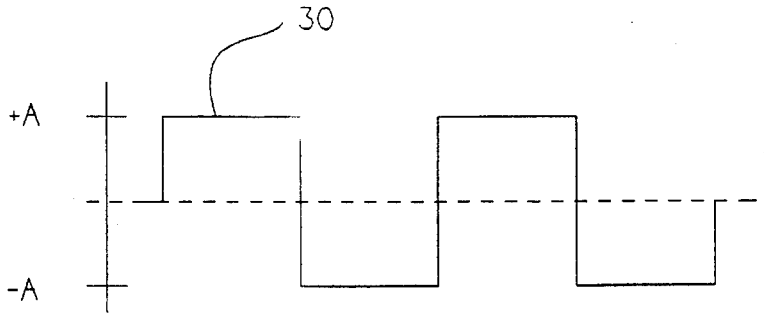
FIG. 2*a–d* illustrated stepped-square waves used for signaling according to the invention herein.
Figure 2B:
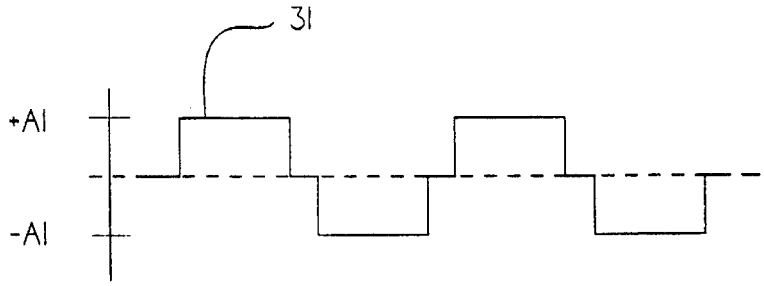
Figure 2C:
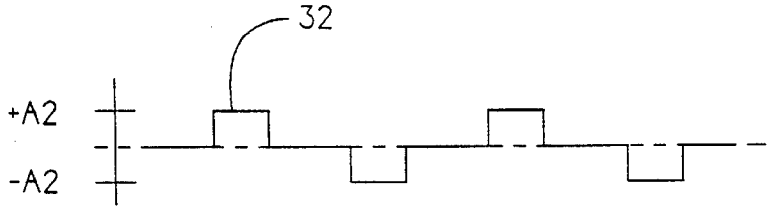
Figure 2D:
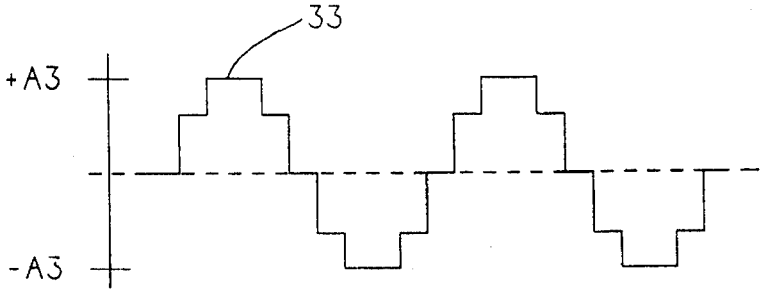

FIG. 2*d* illustrates a stepped-square wave 33 which can be used to transmit information such as, for example, railcar speed limit information. Wave 33 is a composite waveform composed of the sum of the two waves 31 (FIG. 2*b*) and 32 (FIG. 2C). Each of these two constituent square waves 31, 32 have a specific amplitude, namely A1 and A2, respectively, and duty cycle, namely P1 and P2, respectively.

A standard tool for analyzing periodic waves is the Fourier Series, which allows any periodic wave to be represented mathematically by the sum of its fundamental frequency and all harmonics thereof, each of these frequency components having a specific amplitude.

In FIG. 2*d*, the Fourier Series of composite wave 33 can be represented in terms of the amplitudes and duty cycles of its two constituent waves, 31 and 32:

$$V(t)=\sum_{m=1,3,\ldots}\left\{\frac{4}{m\cdot\pi}\cdot\sin\left(\frac{m\cdot\pi}{2}\right)\cdot\left[A1\cdot\sin\left(\frac{m\cdot\pi\cdot P1}{2}\right)+A2\cdot\sin\left(\frac{m\cdot\pi\cdot P2}{2}\right)\right]\right\}\cdot\sin\frac{(m\cdot 2\cdot\pi\cdot P2}{2}\Bigg)\Bigg]\Bigg\}\cdot\sin(m\cdot 2\cdot\pi\cdot f\cdot t)$$

where

A1, A2 are the amplitudes of the first and second square waves 31 and 32, respectively;

P1 and P2 are the duty cycles of the first and second square waves 31 and 32, respectively;

f is the fundamental frequency of wave 30 and 31;

m represents the harmonic order.

Likewise, for a standard "On-Off" square wave such as, for example, wave 30 in FIG. 2*a:*

$$V(t)=\sum_{m=1,3,\ldots}\left\{\frac{4\cdot A}{m\cdot\pi}\right\}\cdot\sin(m\cdot 2\cdot\pi\cdot f\cdot t)$$

where

A is the amplitude of wave 30, f is the fundamental frequency of wave 30, and m is the harmonic order.

The significance of these two expressions is that they allow the harmonic content of wave 33 to be compared mathematically with the harmonic content of a standard "On-Off" square wave 30. For the invention herein, it is preferred that duty cycle of first square wave, P1, generally be between 0.60 and 0.90, particularly between 0.76 and 0.84, with a preferred value of about 0.8, and that the duty cycle of the second square wave, P2, generally be between 0.20 and 0.50, particularly between 0.38 and 0.42, with a preferred value of about 0.4. It is similarly preferred that the amplitude of the first square wave A1 generally be between 0.80 and 1.20, particularly between 0.95 and 1.05, with a preferred value of about 1.00, and that the amplitude of the second square wave A2 generally be between 0.40 and 0.80, particularly between 0.594 and 0.656, with a preferred value of about 0.625.

TABLE 1

| HARMONIC | "ON-OFF" SQUARE WAVE AMPLITUDE | STEPPED-SQUARE WAVE AMPLITUDE |
|---|---|---|
| 3 | 0.3333 | 0.0017 |
| 5 | 0.5000 | 0.0000 |
| 7 | 0.1429 | 0.0007 |
| 9 | 0.1111 | 0.1111 |
| 11 | 0.0909 | 0.0909 |
| 13 | 0.0769 | 0.0004 |
| 15 | 0.0667 | 0.0000 |
| 17 | 0.0588 | 0.0003 |

In Table 1, the relative amplitude values of an exemplary composite stepped-square wave are compared to the relative amplitude values of a standard "On-Off" square wave, at particular harmonic frequencies using Fourier analysis. The values of the simulated stepped-square wave were produced using the aforementioned preferred duty cycle and amplitude values. Table 1 indicates that this combination of duty cycles and amplitudes essentially eliminates the energy content normally associated with the third, fifth, and seventh harmonics. While certain higher-order harmonics such as the ninth and eleventh are substantially unattenuated relative to a square wave, these frequencies generally have lower energy content and can be far enough away from the fundamental to be attenuated by a simple filter. By altering the constituent wave amplitude and duty cycles, a different mix of harmonics can be produced.

Figure 3A:
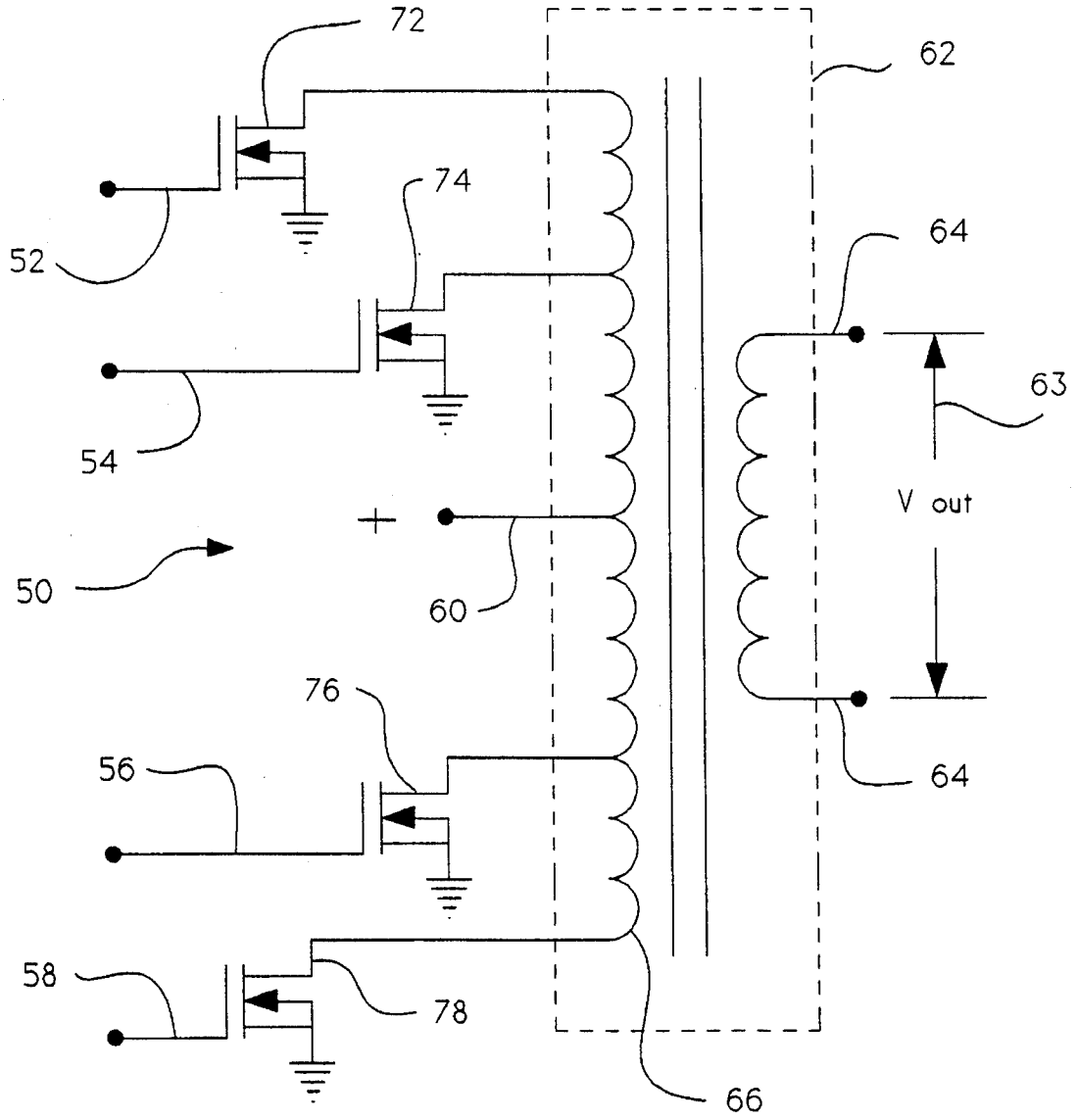
FIG. 3*a* is a diagram of one embodiment of a stepped-square wave generator.

FIG. 3*a* shows one present preferred embodiment of signaling transmitter 50. Multi-tap transformer 62 employs a plurality of drive switches 72, 74, 76, 78, to selectively fashion an output voltage 63 of a preselected waveform on output terminals 64. Drive switches 72, 74, 76, 78, which are preferred to be semiconductor switches and more preferably, field effect transistors, are operated by synchronized timing signals which are selectively applied to gate drive inputs 52, 54, 56, 58. DC input 60, which is preferably a nominal 12 VDC battery, drives multi-tap transformer 62 in a push-pull configuration.

Two taps can be placed on primary winding 66 to produce an upper step in the voltage waveform. The amplitude of the upper step can be a function of the turns ratio in the primary windings. To substantially reduce the amplitude of the specific harmonics, the ratios of the total number of primary turns with the number of turns at a particular tap can be preselected. For example, to substantially reduce the amplitude of the third, fifth and seventh harmonics, the ratio of the total number of turns to the number of turns at the first and second taps are preferred to be about 1.000 and 1.625, respectively. In addition, because the voltage amplitudes of the step waveforms can be functions of the turns ratios of the primary windings, the voltage amplitude of a particular step may also be preselected. For example, in the case where the first and second turns ratios are about 1.000 and 1.625, the amplitude ratios of the voltages at the respective taps are about 1.00 and 1.62.

Figure 3B:
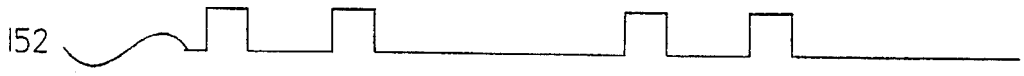
FIG. 3*b–f* illustrates exemplary gate drive signals and resultant voltage output of the stepped-square wave generator of FIG. 3*a*.
Figure 3C:
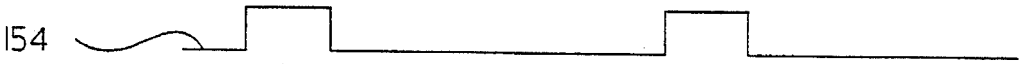
Figure 3D:
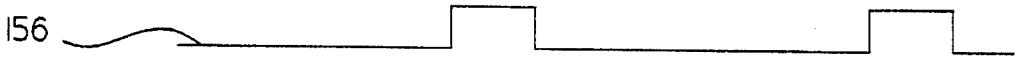
Figure 3E:
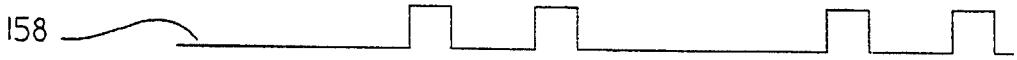
Figure 3F:
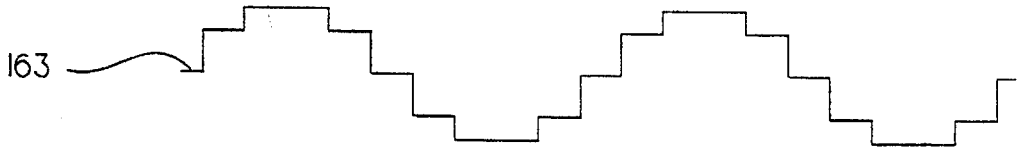

FIG. 3*b–f* present exemplary gate timing diagrams and a resultant waveform which can be created by signaling transmitter 50 of FIG. 3*a*, having four drive switches, 72, 74, 76, 78. In FIG. 3*b*, drive signal 152 represents the synchronized timing signal which can be applied by gate drive input 52 to drive switch 72 in FIG. 3*a*. Similarly in FIG. 8*a*, drive signal 154 can be applied by gate drive input 54 to drive switch 74. Drive signal 156 in FIG. 3*d* can be applied by gate drive input 56 to drive switch 76. And drive signal 158 in FIG. 3*e* can be applied by gate drive input 58 to drive switch 78. The selective application of such drive signals 152, 154, 156, 158 to drive switches 72, 74, 76, 78, respectively, produces resultant output voltage 163, shown in FIG. 3*f* across output terminals 64.

Figure 4:
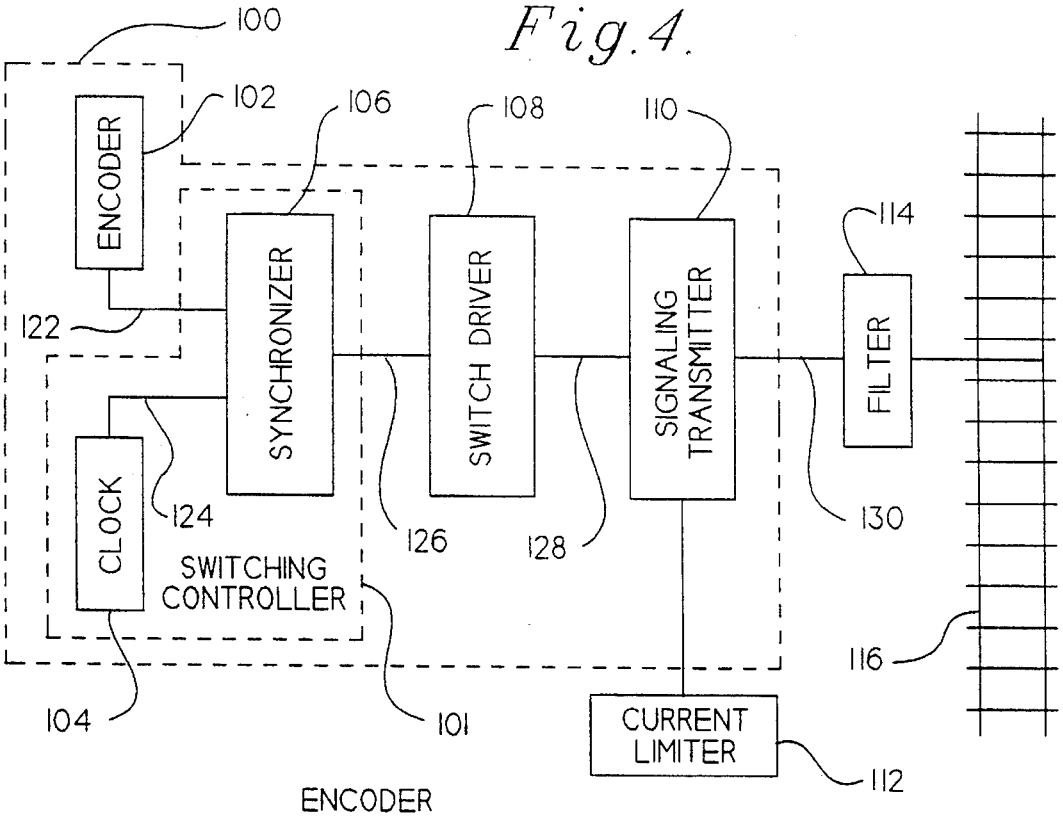
FIG. 4 is a diagram of one embodiment of a stepped-square wave generator according to the invention herein.

One preferred embodiment of a stepped-square wave generator 100 is shown in FIG. 4. Encoder 102 provides encoded information signal 122 to synchronizer 106. Clock 104 generates clocking signal 124 at a predetermined frequency, and also provides signal 124 to synchronizer 106. Synchronizer 106 fashions from signals 122 and 124, input drive signal 126 which can be used to operate switch driver 108. Alternatively, input drive signal 126 may be produced by switching controller 101. In this case, switching controller 101 can be responsive to encoded information signal 122 from encoder 102. Switching controller 101 may include clock 104 and synchronizer 106 therewithin. Switch driver 108 selectively produces gate drive signal 128 to signaling transmitter 110. Signaling transmitter 110 produces signaling waveform 130, which signaling waveform 130 has an information signal encoded thereupon. It may be desirable to electrically isolate signaling transmitter 110 from other signals which may be present on track 116, in which case tuned output filter 114 can be provided. Also, current limiter 112 can be provided to prevent excessive heating of the semiconductor switching circuits in signaling transmitter 110 during high-current draw conditions such as, for example, when a train is stopped on top of the track connection. Information may be encoded by turning on and off transmitter 100 at the preselected encoding rate of encoder 102. These encoding rates can be, for example, 75, 120 and 180 CPM.

Figure 5A:
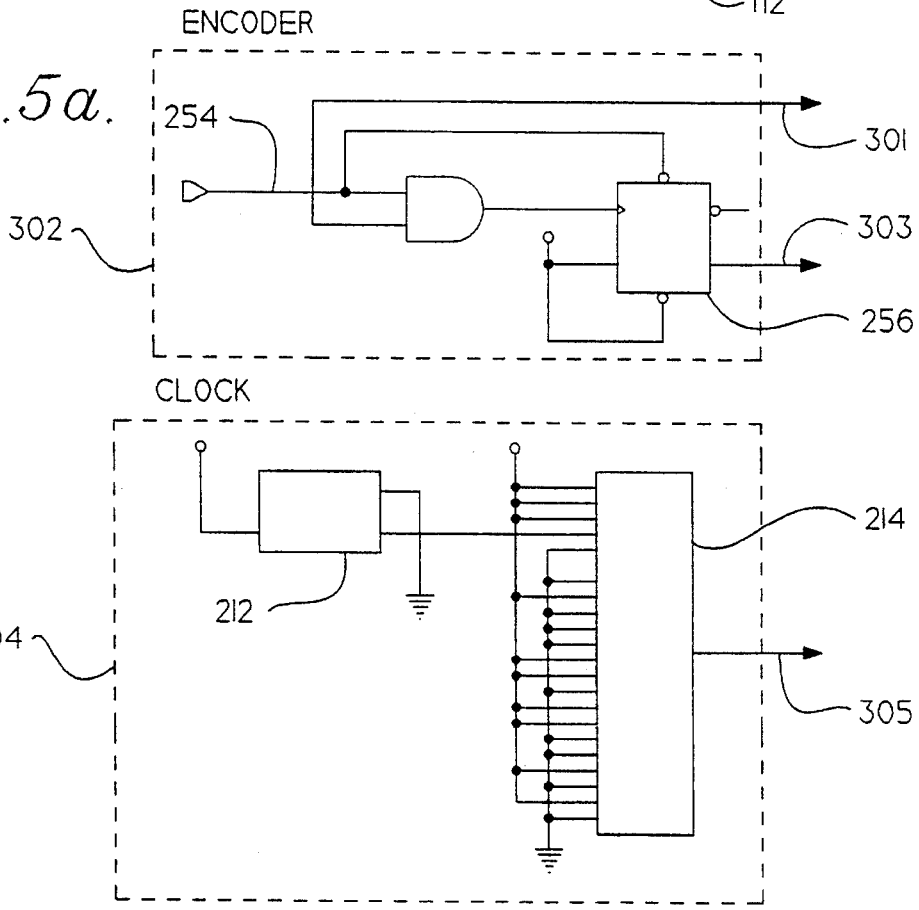
FIG. 5*a* illustrates a clock and encoder which may be included in a stepped-square wave generator according to the invention herein.
Figure 5B:
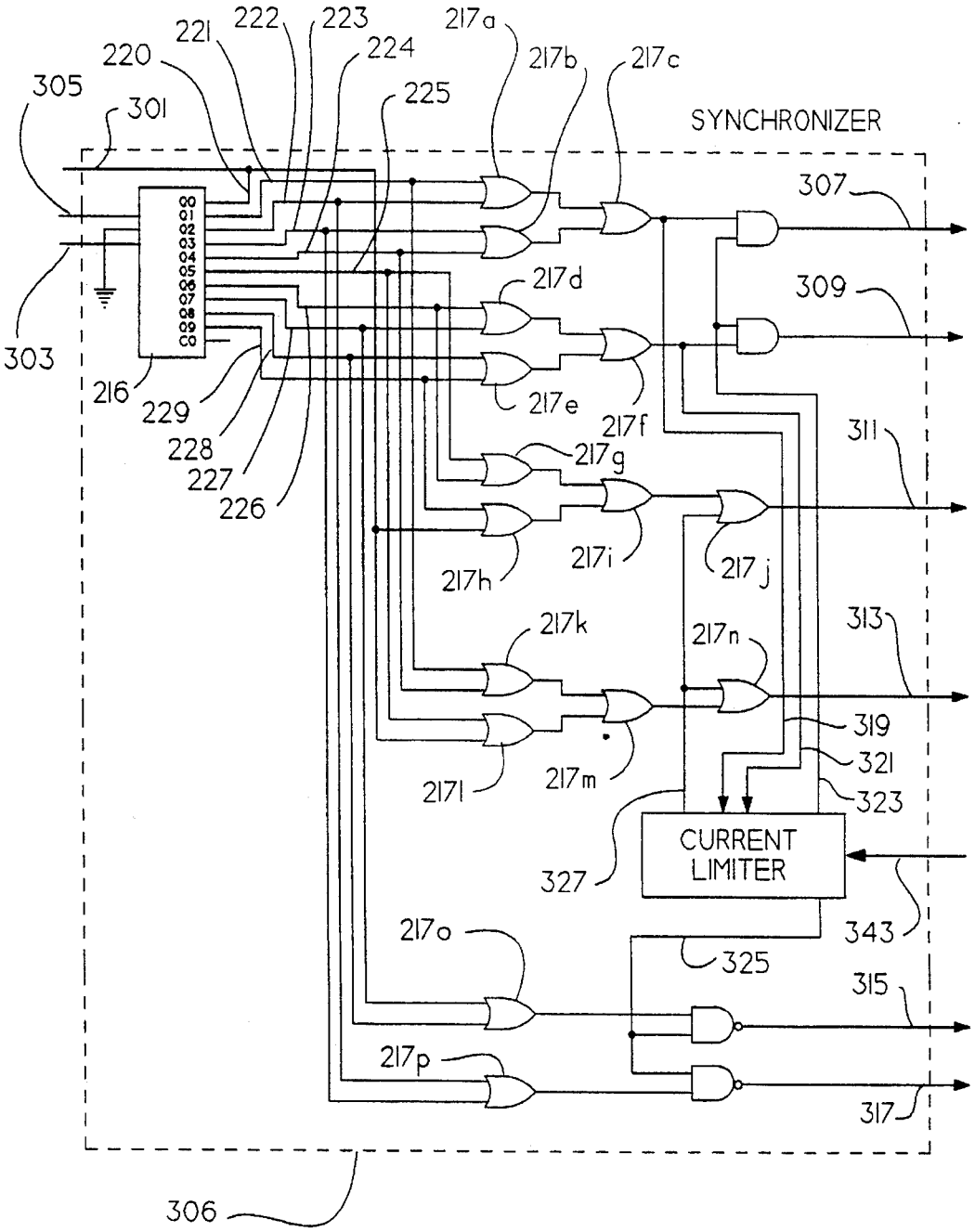
FIG. 5*b* illustrates a synchronizer which may be included in a stepped-square wave generator according to the invention herein.
Figure 5C:
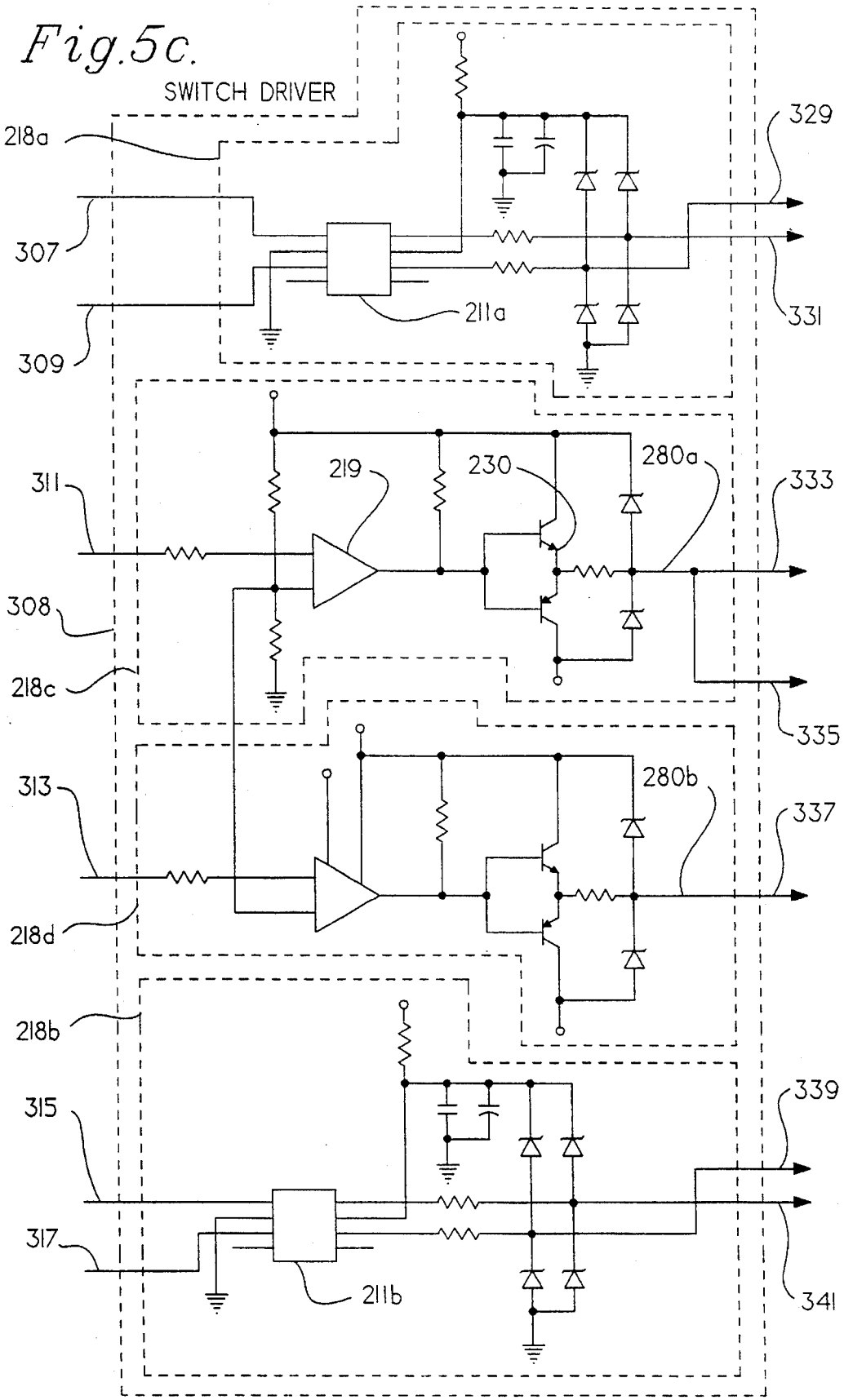
FIG. 5*c* illustrates a switch driver which may be included in a stepped-square wave generator according to the invention herein.
Figure 5D:
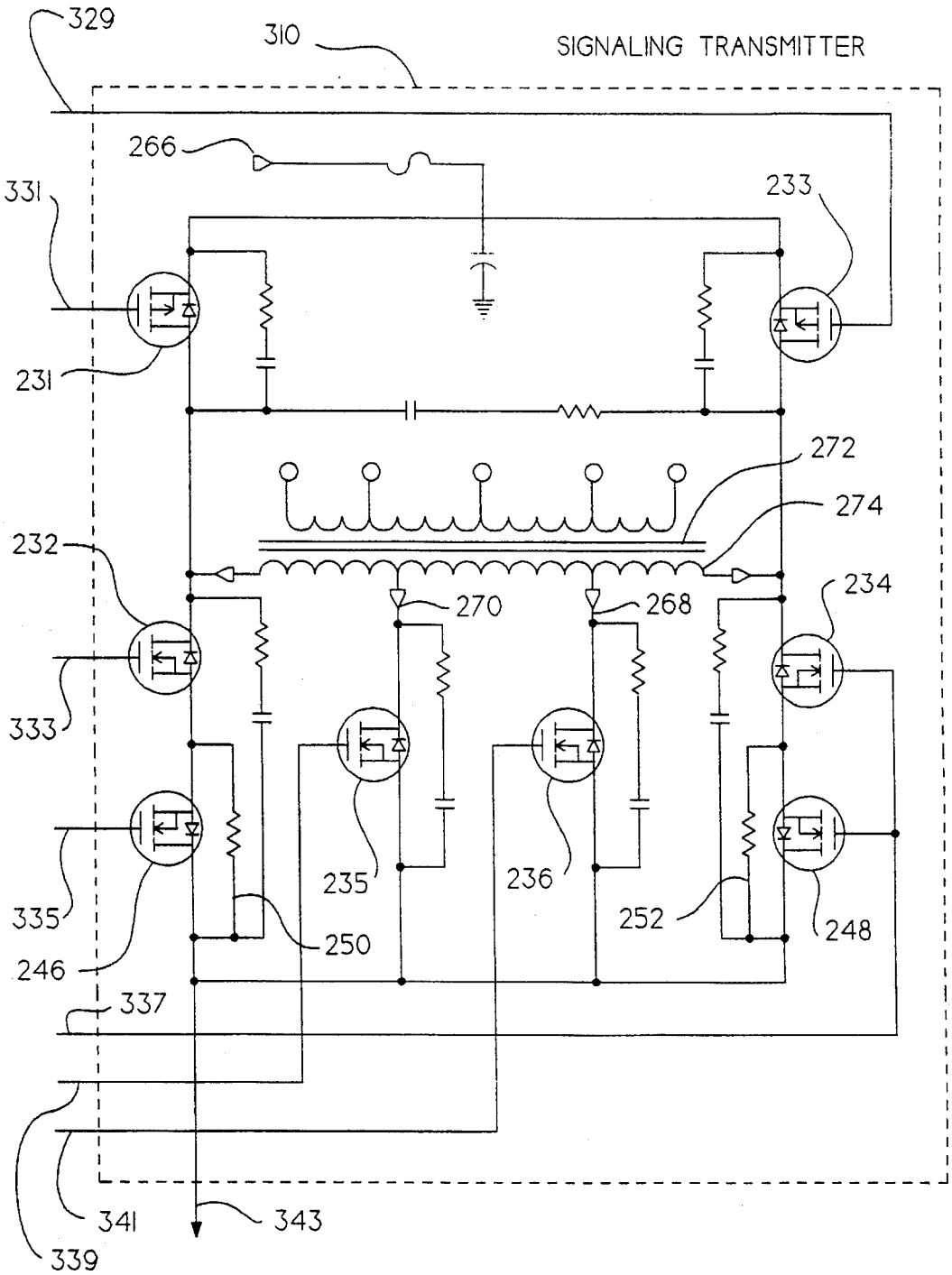
FIG. 5*d* illustrates a signaling transmitter which may be included in a stepped-square wave generator according to the invention herein.

FIG. 5*a* illustrates encoder 302 and clock 304 which are similar to respective encoder 102 and clock 104 shown in FIG. 4. Synchronizer 306 in FIG. 5*b* is similar to synchronizer 106 in FIG. 4. FIG. 5*c* illustrates switch driver 308 which is similar to switch driver 108 in FIG. 4. FIG. 5*d* illustrates signaling transmitter 310 which is similar to signaling transmitter 110 in FIG. 4. Signals 301, 303 and 305 in FIG. 5*a* correspond to signals 301, 303 and 305 in FIG. 5*b*. Signals 307, 309, 311, 313, 315 and 317 in FIG. 5*b* correspond to signals 307, 309, 311, 313, 315 and 317 in FIG. 5*c*. Signals 329, 331, 333, 335, 337, 339 and 341 in FIG. 5*c* correspond to signals 329, 331, 333, 335, 337, 339 and 341 in FIG. 5*d*. Signals 319, 321, 323, 325 and 327 in FIG. 5*b* correspond to signals 319, 321, 323, 325 and 327 in FIG. 5*e*. Signal 343 in FIG. 5*b* corresponds to signal 343 in FIGS. 5*d* and 5*e*.

In clock 304 of FIG. 5*a*, oscillator 212 generates a preselected frequency such as, for example, 1.8432 Mhz, which is divided down by divide-by-N counter 214 to produce a signal 305 at a desired frequency such as, for example, 600 Hz. Signal 305 is used to drive decade counter 216 in the synchronizer in FIG. 5*b*. Each of the 10 outputs 220–229 (Q0–Q9) of decade counter 216 provide clocking pulses at one tenth of the frequency of signal 305, for example, 60 Hz. Each of the outputs 220–229 (Q0–Q9) turns on at the same time with respect to the other outputs 220–229 (Q0–Q9). For example, at start-up, output 220 (Q0) will turn on first and, when Q0 turns off, output 221 (Q1) will turn on. This process continues through to output 229 (Q9), recommencing the process by again turning on output 220 (Q0). Continuing in FIG. 5*a*, counter 214 in clock 304 may be programmed to provide the desired carrier frequency. For example, where the carrier frequency is desired to be 60 Hz, counter 214 can be programmed to divide by 3072 to produce a 600 Hz output on signal 305. Where a 100 Hz carrier frequency is desired, counter 214 in clock 304 may be programmed to divide by 1843 thereby providing signal 305 with a frequency of 1000 Hz.

Code input 254 in encoder 302 allows the transmitter to be turned on and off at preselected coding frequencies such as, for example, 75, 120, and 180 CPM. The code signal from input 254 passes through flip-flop 256 onto reset line 303 of decade counter 216, shown in FIG. 5*b*. When the code input 254 is high, only output 220 (Q0) of counter 216 is high, all other outputs 221, 229 (Q1–Q9) are low, and the transmitter is turned off. When code input 254 goes low, counter 216 starts a pulse train on output 220 (Q0). It is desirable that every time the transmitter is turned on, it starts at the beginning of the cycle of counter 216. Flip-flop 256 in FIG. 5*a* controls the transmitter turn-off by keeping reset line 303 low until output 220 (Q0) goes high. Because output 220 (Q0) is the end of the counter cycle, the transmitter is turned off at the zerocrossing. This produces an integer number of carrier cycles during the carrier on-time. During the carrier off-time, primary windings 274 in FIG. 5*d* are shorted to ground by turning on FETs 232, 246, 234, and 248. This is accomplished by counter output 220 (Q0) which goes high when counter 216 is reset. It is desirable to not permit primary windings 274 to be left floating or unconnected.

The transistor gate drive signals may be derived from the outputs 220–229 of counter 216 by selectively combining outputs 220–229 using sequential logic devices including a plurality of OR gates 217*a*–217*p* as illustrated in FIG. 5*b*. For example, to produce the drive signal for FET 231 in FIG. 5*d*, four outputs 221–224 (Q1–Q4) are OR-ed together, as shown in FIG. 5*b*. This generates a pulse or signal 307 that is on for 40% of the cycle time. Switching drive circuit 218*a* in switch driver 308 of FIG. 5*c* drives FETs 231 and 233 by using FET driver 211*a* to invert signal 307. Drive circuit 218*a* is provided power by battery 266 in FIG. 5*d* to ensure full turn-off of the p-channel FETs 231 and 233 in FIG. 5*d*. Similarly, switching drive circuit 218*b* drives FETs 235 and 236 in FIG. 5*d*.

Switching drive circuit 218*c* in FIG. 5*c* can include voltage comparator 219, along with a push-pull transistor circuit 230, to drive FETs 232 and 246 in FIG. 5*d*. Similarly, switching drive circuit 218*d* in FIG. 5*c* drives FETs 234 and 248 in FIG. 5*d*. The gate drive signals 280*a* and 280*b* switch between +12 volts and −12 volts. The −12 volts is provided to overcome the negative voltage which may be produced by transformer 272 in FIG. 5*d* when FETs 232, 246, 234, and 248 are turned off.

Continuing in signaling transmitter 310 of FIG. 5*d*, two n-channel FETs 246, 248 are put in series with FETs 232 and 234, respectively, to block the flow of current in the reverse direction through the internal diode when FETs 232 and 234 are turned off. The ground reference resistors 250, 252 are connected between the sources of FETs 232 and 234, respectively, and ground thereby providing a ground reference to keep the respective transistor sources from floating.

Transformer 272 is driven in a full-bridge configuration from a nominal 12 volt battery 266. Two taps 268, 270 have been placed on primary windings 274 to produce the upper step in the output waveform. The amplitude of the upper step is a function of the turns ratio in primary windings 274. The amplitude ratio of these two steps may be manipulated to minimize particular frequencies. For example, to substantially reduce the third, fifth, and seventh harmonic frequencies, it is desired to provide an amplitude ratio of the two steps to be approximately 1.00 and 1.62. With relation to the number of turns in the primary, the ratio may be determined such that the total number of primary turns divided by the number of turns at the particular tap, for example, tap 268 is approximately equal to the desired amplitude ratio. For example, where the total number of turns in primary 274 is about 104, and the number of turns at tap 268 is 64 turns, the turns ratio will be about 1.625; the associated amplitude ratio is about 1.62.

A current limiter circuit may be composed of a voltage sensor, such as sense resistors 244*a* and 244*b*, comparator 240 and flip-flop 242. When the voltage across sense resistor 244*a*, 244*b* exceeds the trip point of comparator 240, flip-flop 242 is triggered. The output of flip-flop 242 in FIG. 5*e* turns off FETs 231, 233, 235 and 236, and turns on FETs 232, 246, 234, and 248 in FIG. 5*d*. Flip-flop 242 is reset at the beginning of the next half-cycle to return the circuit to normal operation. The current limiting circuit 312 may be necessary to prevent excessive heating of the switching FETs 231–236 when a train is stopped on top of a track connection.

FIGS. 6*a*–*g* present exemplary gate timing diagrams and a resultant output stepped-square waveform which can be created by the stepped-square wave generator illustrated in FIGS. 5*a*–5*d* and current limiter 5*e*, and the description relating thereto. Drive signals 401 (shown in FIG. 6*b*), 404 (shown in FIG. 6*c*), 406 (shown in FIG. 6*d*), 403 (shown in FIG. 6*e*), 402 (shown in FIG. 6*f*), and 405 (shown in FIG. 6*g*) are similar to drive signals 331, 337, 341, 329, 333 and 339, respectively, in FIG. 5d. In FIG. 6*b*, FET drive signal 401 represents the synchronized timing signal which can be applied to FET 231 in FIG. 5d. Similarly, FET drive signals 404, 406, 403, 402 and 405 in FIGS. 6*c–g* represent the synchronized timing signal which can be applied to FETs 234, 236, 233, 232 and 235, respectively in FIG. 5*d*. The selective application of FET drive signals 401, 404, 406, 403,402 and 405 produces resultant output voltage 400, with the waveform having the stepped-square wave morphology, characteristic of the invention herein.

Figure 5E:
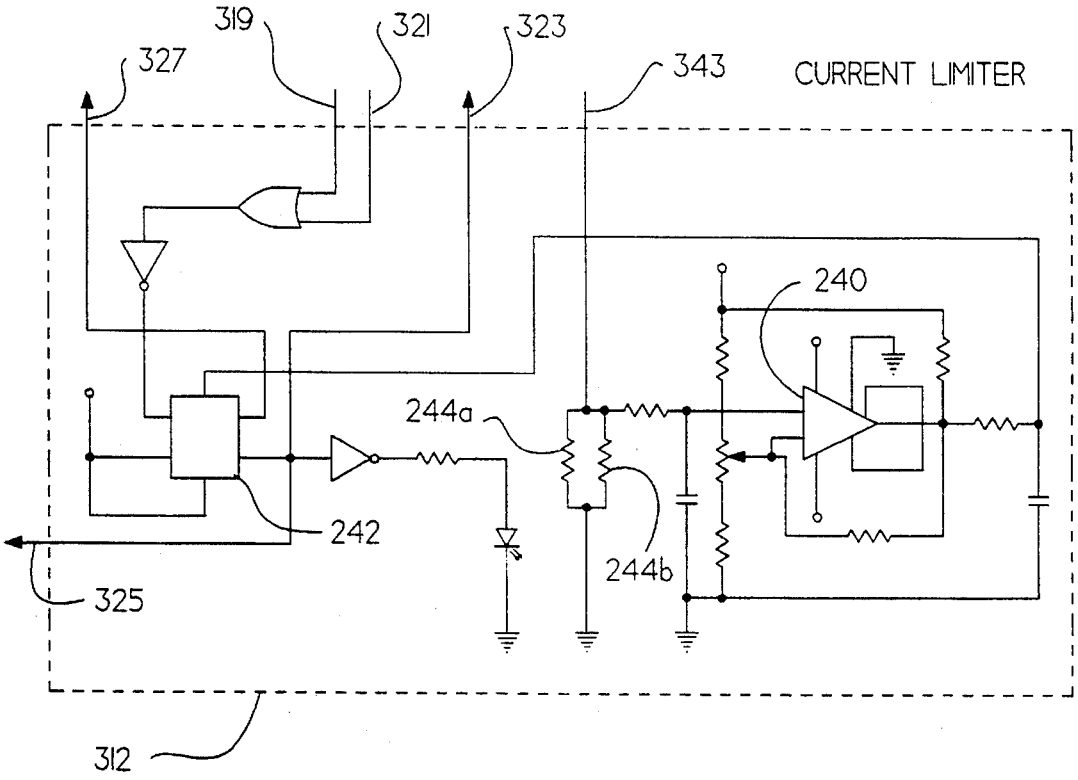
FIG. 5*e* illustrates a current limiter which may be included in an information signal transmitter according to the invention herein.

Also illustrated in FIG. 6 *a* is an exemplary limiting of the waveform of output voltage 400 which may be encountered during the operation of current limiter 312, in FIG. 5*e*, as previously described.

While certain present embodiments of the invention have been illustrated, it is understood that the invention is not limited thereto, and may be otherwise variously embodied and practiced within the scope of the following claims.

We claim:

1. A signaling apparatus for transmitting information from wayside to a railway vehicle comprising an information signal transmitter having a stepped-square wave generator for generating a stepped-square wave signaling waveform output, said stepped-square wave signaling waveform output, having a plurality of square wave signals, said stepped-square wave signaling waveform output having information encoded thereupon, and said transmitter transmitting said stepped-square wave signaling waveform output onto rails of a track, said railway vehicle receiving said stepped-square wave signaling waveform output thereby.

2. The signaling apparatus of claim 1 wherein said transmitter is a switching-mode transmitter.

3. The signaling apparatus of claim 1 wherein at least a portion of a first preselected duty cycle of at least one of said plurality of square wave signals overlaps at least a portion of a second preselected duty cycle of at least one other of said plurality of square wave signals so that said signaling waveform is generally a stepped-square waveform.

4. A method for signaling, comprising the steps of generating a multi-stepped square waveform having a series of superimposed square waves and at least two waves of said series of superimposed square waves having preselected amplitudes; injecting said waveform into a railway signaling circuit; and overlapping the duty cycle of a first of said at least two waves with the duty cycle of a second of said at least two waves, said overlapping producing a multi-step carrier waveform having a single high-amplitude square wave interposed between two lower amplitude square waves.

5. The method of claim 4 further comprising encoding an information signal on said multi-step carrier waveform, creating a coded-carrier signal thereby.

6. The method of claim 5 further comprising injecting said coded-carrier signal into a railway track for providing information to a railway vehicle.

7. A method for signaling, comprising the steps of:

a. generating a plurality of square wave signals, and said plurality of square wave signals having a plurality of predetermined duty cycles;

b. overlapping at least a portion of a first preselected duty cycle of at least one of said plurality of square wave signals with at least a portion of a second preselected duty cycle of at least one other of said plurality of square wave signals so that a stepped-square waveform results therefrom, and said stepped-square waveform having a predetermined frequency;

c. encoding an information signal at a preselected frequency upon at least a portion of said stepped-square waveform; and d. transmitting said stepped-square waveform having said information signal encoded thereupon into a transmission medium, and at least a portion of said transmission medium being a portion of railroad track.

8. The method of claim 7 further comprising the steps of:

e. receiving said stepped-square waveform having said information signal encoded thereupon from said transmission medium; and f. decoding said information signal from said stepped-square waveform.

* * * * *